US010803841B2

(12) United States Patent
Campbell et al.

(10) Patent No.: US 10,803,841 B2
(45) Date of Patent: Oct. 13, 2020

(54) MOTORIZED INSTRUMENT STRUMMER

(71) Applicants: Mitchell Duane Campbell, Celina, OH (US); Tim Richard Townsend, Celina, OH (US)

(72) Inventors: Mitchell Duane Campbell, Celina, OH (US); Tim Richard Townsend, Celina, OH (US)

( * ) Notice: Subject to any disclaimer, the term of this patent is extended or adjusted under 35 U.S.C. 154(b) by 0 days.

(21) Appl. No.: 16/448,813

(22) Filed: Jun. 21, 2019

(65) Prior Publication Data

US 2019/0392794 A1 Dec. 26, 2019

Related U.S. Application Data

(60) Provisional application No. 62/688,092, filed on Jun. 21, 2018.

(51) Int. Cl.

| | |
|---|---|
| ***G10D 3/16*** | (2020.01) |
| ***G10F 1/20*** | (2006.01) |
| ***G10D 3/14*** | (2020.01) |
| ***G10H 3/12*** | (2006.01) |
| ***G10H 3/18*** | (2006.01) |

(52) U.S. Cl.

CPC ..... *G10F 1/20* (2013.01); *G10D 3/14* (2013.01); *G10H 3/125* (2013.01); *G10H 3/188* (2013.01); *G10H 2220/461* (2013.01)

(58) Field of Classification Search

CPC . G10F 1/20; G10D 3/14; G10H 3/125; G10H 3/188; G10H 2220/461

USPC ..... 84/322

See application file for complete search history.

(56) References Cited

U.S. PATENT DOCUMENTS

| | | | | |
|---|---|---|---|---|
| 5,212,330 | A | 5/1993 | Cooper | |
| 6,723,904 | B1 * | 4/2004 | Dolan | G10D 3/00 84/267 |
| 7,557,283 | B1 * | 7/2009 | Moncrief | G10D 3/00 84/319 |
| 9,117,427 | B2 * | 8/2015 | Piccionelli | G10D 13/12 |

* cited by examiner

*Primary Examiner* — Jianchun Qin

(74) *Attorney, Agent, or Firm* — Jacob M. Ward; Ward Law Office LLC

(57) ABSTRACT

A hand-held strumming device includes a hollow body, a power source, a motor, a regulator, and a strummer. The power source is disposed in the hollow body. The motor is in electrical communication with the power source. The regulator is in electrical communication with both the motor and the power source. The regulator is configured to selectively adjust a rotational speed of the motor. The strummer is rotatably disposed on the disk. The strummer is configured to be presented to strings of a stringed instrument upon rotation of the motor to strum the strings.

20 Claims, 3 Drawing Sheets

MOTORIZED INSTRUMENT STRUMMER

CROSS-REFERENCE TO RELATED APPLICATIONS

This application claims the benefit of U.S. Provisional Application No. 62/688,092, filed on Jun. 21, 2018. The entire disclosure of the above application is hereby incorporated herein by reference.

FIELD

The present disclosure relates to stringed instruments and, more particularly, to a device used for strumming stringed instruments.

BACKGROUND

The beginning phase of learning a stringed instrument can be troublesome due to having to learn different concepts simultaneously. In particular, novice musicians can struggle with the guitar due to the need to focus on strumming and fretting simultaneously. This split focus results in a longer learning process.

In addition, disabled or elderly musicians may find strumming and fretting simultaneously difficult based on physical discomfort or lack of mental agility. Undesirably, this can lead to disabled or elderly musicians not participating in the music industry.

Automating the strumming of stringed instruments is known, for example, as described in U.S. Pat. No. 5,212,330 to Cooper. However, the Cooper device is large and unwieldy, complicated to use, expensive, and can be cumbersome by restricting a musician's range of motion.

There is a continuing need for a handheld, user-friendly, and inexpensive device and method for automating strumming of stringed instruments. Desirably, the device allows the musician to have a full range of motion while playing.

SUMMARY

In concordance with the instant disclosure, a handheld, user-friendly, and inexpensive device and method for automating strumming of stringed instruments, and which allows the musician to have a full range of motion while playing, has been surprisingly discovered.

In one embodiment, a hand-held strumming device includes a hollow body, a power source, a motor, a regulator, and a strummer. The power source is disposed in the hollow body. The motor is in electrical communication with the power source. The regulator is in electrical communication with both the motor and the power source. The regulator is configured to selectively adjust a rotational speed of the motor. The strummer is rotatably disposed on the disk. The strummer is configured to be presented to strings of a stringed instrument upon rotation of the motor to strum the strings.

In another embodiment, a method of playing a stringed instrument includes the first step of providing the above-mentioned hand-held strumming device. Then, providing a stringed instrument. Next, the hand-held strumming device is presented to the strings of the stringed instrument. Then, the stringed instrument is strummed automatically with the hand-held strumming device. Next, the stringed instrument is fretted while the musician is able to focus solely on fretting due to the automation of the strumming.

In a further embodiment, a hand-held strumming device, includes a hollow body, a rechargeable battery, a direct current (DC) motor, a regulator, a disk, a strummer, a port, a plectrum, and a power switch. The rechargeable battery is disposed in the hollow body. The DC motor is in electrical communication with the rechargeable battery. The DC motor has a shaft. The regulator has a rotatable manual adjuster. The regulator is in electrical communication with both the DC motor and the rechargeable battery. The regulator is configured to selectively adjust a rotational speed of the DC motor. The rotatable manual adjuster is disposed on an outer surface of the hollow body. The rotatable manual adjuster is textured and facilitates a gripping of the manual adjuster by a musician. A position of the manual adjuster allows a thumb or index finger of the musician to selectively adjust the rotational speed of the DC motor while the musician holds the hollow body. The disk is attached to the shaft of the DC motor. The disk is configured to rotate via the DC motor. The disk includes an aperture and a fastener. The aperture is formed on the disk adjacent a perimeter of the disk. The fastener is disposed on the disk and removably secures the disk to the shaft of the DC motor. The strummer is rotatably disposed on the disk. The aperture of the disk removably receives the strummer. The strummer is configured to be presented to strings of a stringed instrument upon rotation of the disk to strum the strings. The port is disposed through the hollow body and is in electrical communication with the rechargeable battery. The plectrum is disposed on the hollow body. The plectrum permits for a picking of individual strings of the stringed instrument. The power switch is in electrical communication with both the rechargeable battery and the DC motor. The power switch is configured to selectively activate and deactivate the DC motor.

In an exemplary embodiment, the hand-held strumming device includes a hollow body, a cylindrical housing that includes a direct current motor, a potentiometer, a power source, a rotatable spindle, and a wire attached to the rotatable spindle. The power source powers the direct current motor, which rotates the rotatable spindle. This rotation causes the wire to be presented to the guitar strings in such a way as to strum the guitar without the transverse hand and lower arm movement associated with a normal strum. The potentiometer acts as a variable resistor and varies the voltage from the power source. The musician can adjust the potentiometer causing the direct current motor to go faster or slower, directly impacting the strumming speed.

Additionally, the hand-held motorized guitar strummer can include a conventional guitar pick affixed to the cylindrical housing.

Automating the strumming allows a novice to focus more on fretting without the challenge of strumming the strings at the same time. In addition, this may allow a disabled guitarist to play the guitar easier.

A non-limiting example of a potentiometer has the dimensions of 1.2 inches by 0.6 inches by 0.3 inches. The potentiometer acts as a variable resistor for the power source. The guitarist can adjust the potentiometer causing the direct current motor to go faster or slower which directly impacts the strumming speed.

A non-limiting example of a direct current motor has the dimensions of 24 mm by 12 mm.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described herein.

DETAILED DESCRIPTION

Figure 1:
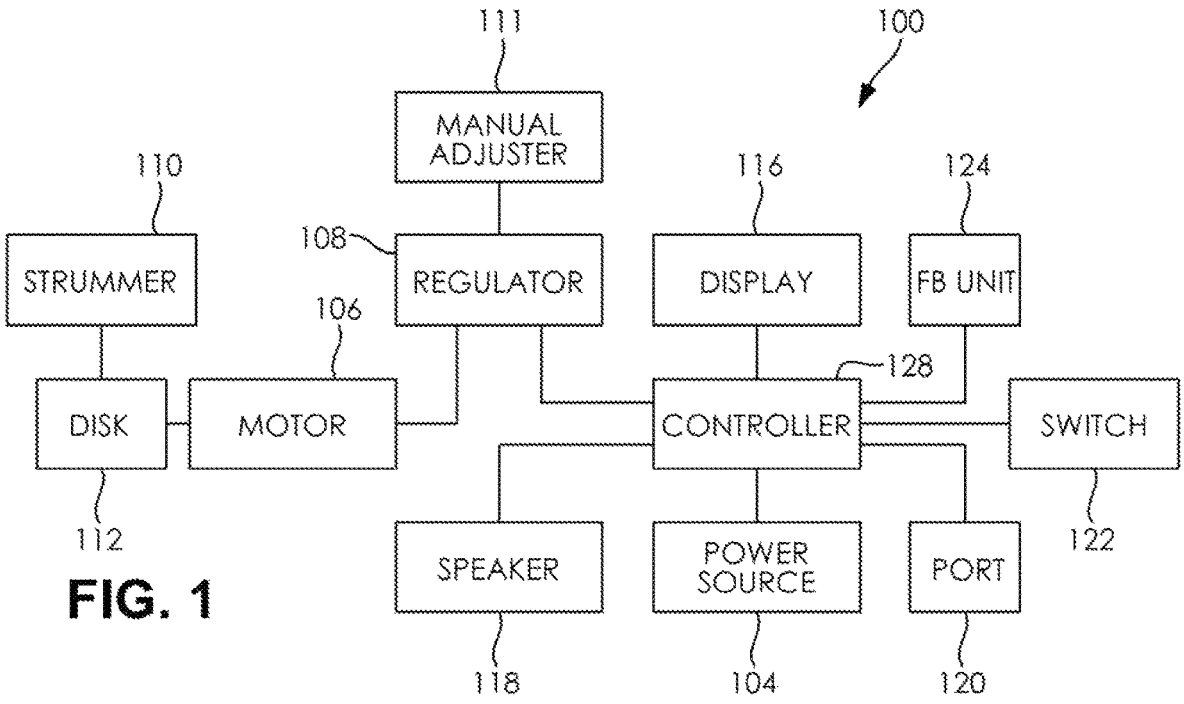
FIG. 1 is a schematic view of a hand-held strumming device according to one embodiment of the present disclosure.

The following detailed description and appended drawings describe and illustrate various embodiments of the invention. The description and drawings serve to enable one skilled in the art to make and use the invention and are not intended to limit the scope of the invention in any manner. In respect of the methods disclosed, the order of the steps presented is exemplary in nature, and thus, is not necessary or critical unless otherwise disclosed.

As shown in FIG. 1-4, a hand-held strumming device 100 includes a hollow body 102, a power source 104, a motor 106, a regulator 108, and a strummer 110. The hollow body 102 has a size and shape that permits the hollow body 102 to be held in one hand. In particular, within 10 inches on all sides, more particularly within 7 inches and most particularly within 4 inches. Advantageously, this allows a musician to only need one hand to use the hand-held strumming device 100, while allowing the other free hand of the musician to fret a stringed instrument 101 (shown in FIG. 4). It should be appreciated that a skilled artisan may select different dimensions of the hollow body 102 that allow it to be used with one hand within the scope of this disclosure.

The shape of the hollow body 102 may also be ergonomic. For example, the shape is designed to be ergonomic to ensure comfortable play sessions. In particular, the hollow body 102 may be substantially cylindrical or ovoid in shape. It should be appreciated that one skilled in the art may select different ergonomic shapes for the hollow body 102 within the scope of this disclosure.

Figure 3:
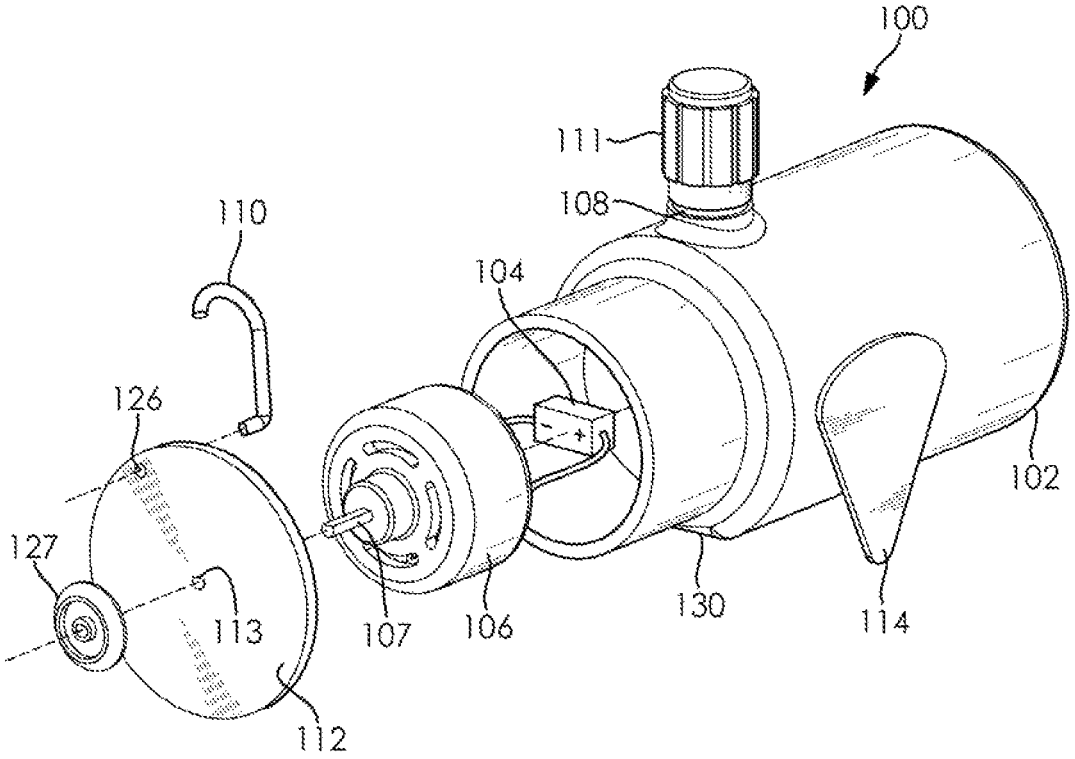
FIG. 3 is an exploded perspective view of the hand-held strumming device shown in FIG. 2.

The power source 104 is in electrical communication with the motor 106 and the regulator 108. In certain examples, as shown in FIG. 3, the power source 104 disposed within the hollow body 102. The power source 104 has an electrical storage capacity sufficient to supply the motor 106 with power for an adequate amount of time to accommodate multiple play sessions.

In some embodiments, the power source 104 is a battery. Desirably, the battery allows a musician to not be restricted by a power cable, and further allows the musician to benefit from the hand-held nature of the device 100. In some instances, the battery is rechargeable. The rechargeable battery conveniently allows the musician to recharge the device instead of having to buy replacement batteries. In other instances, the battery may be removable from the hollow body 102, which permits it to be replaced as needed.

In a specific embodiment, the power source 104 is a 5.6-volt battery. It should be appreciated that although this power source 104 has shown to be useful, other suitable power sources 104 may also be selected by a person skilled in the art within the scope of this disclosure.

As shown in FIGS. 1 and 3, the motor 106 is in electrical communication with both the power source 104 and the regulator 108. For example, the motor 106 may be disposed within the hollow body 102. In addition, the motor 106 is configured to provide sufficient revolutions per minute (rpm), in order to adequality mimic the maximum strum rate of the musician. It should be appreciated that the maximum strum rate is variable and depends on the specific musical application.

In some embodiments, the motor 106 is a direct current (DC) motor. As a nonlimiting example, the motor 106 may be a 3-volt electric motor capable of producing 3,500 rpm. It should be appreciated that, although the 3-volt electric motor has been shown to be useful as the motor 106, other suitable types of motors may also be selected by the skilled artisan, as desired.

With continued reference to FIGS. 1 and 3, the regulator 108 is in electrical communication with both the motor 106 and the power source 104. Also, the regulator 108 is configured to selectively adjust the rotational speed of the motor 106, which in turn directly correlates to the strum rate. Thus, the regulator 108 allows the musician to adjust the strum rate according to the musician's needs.

In certain embodiments, the regulator 108 is a resistor with an adjustable tapping point that slides along the resistance element. In other embodiments, the adjustable tapping point is adjustable by the rotation of a post. In particular embodiments, the regulator 108 is a potentiometer. It should be appreciated that a one skilled in the art may use other methods to adjust the rotational speed of the motor 106 within the scope of this disclosure.

As shown in FIGS. 1-4, the regulator 108 is connected to at least one manual adjuster 111. The manual adjuster 111 allows the musician to more easily control the rotational speed of the motor 106. Nonlimiting examples of the manual adjuster 111 may include tactile sensors, push buttons, dials, levers, and knobs.

Figure 4:
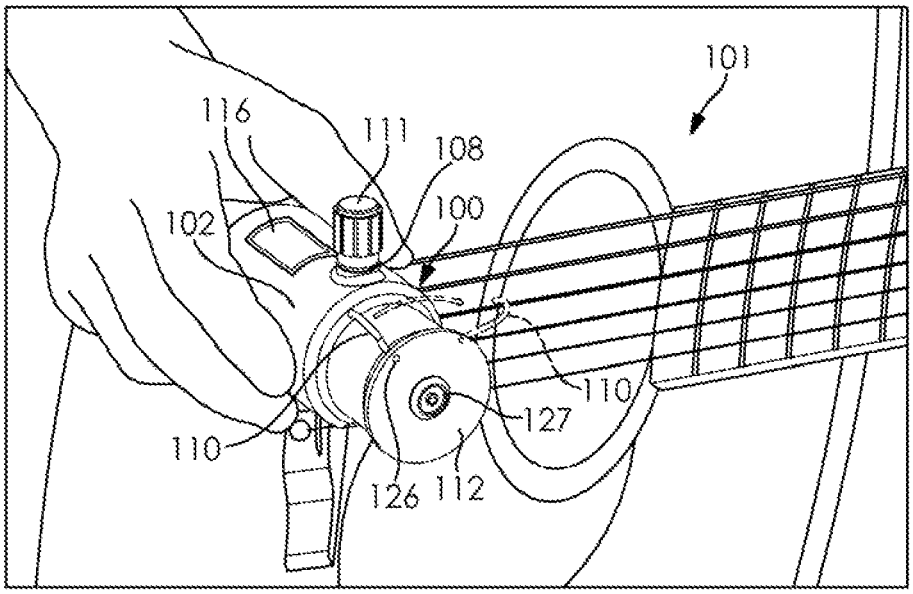
FIG. 4 is a perspective view of the hand-held strumming device shown in FIGS. 2 and 3, with the device further shown in operation and automatically strumming a stringed instrument, as shown in FIG. 1, in use.

Desirably, the positioning of the manual adjuster 111 allows the musician to adjust the rotational speed of the motor 106 simply by using the musician's thumb or index finger of the same hand holding the hand-held strumming device 100, for example, as shown in FIG. 4. Moreover, in some instances the manual adjuster 111 is textured in such a way that provides more traction for the musician's thumb or index finger.

It should be appreciated that a skilled artisan may apply different types of textures or grips to the regulator 108 to provide better traction within the scope of this disclosure. Moreover, a skilled artisan may also select different types of the manual adjuster 111 to allow the musician to more easily control the rotational speed of the motor 106 within the scope of this disclosure.

In a particular embodiment, the regulator 108 is a potentiometer with a post connected to a knob. The potentiometer functions as a variable resistor to adjust the rotational speed of the motor 106 by varying the voltage from the power source 104. As a nonlimiting example, the potentiometer is a 5,000 Ohm potentiometer. It should be appreciated that, although this potentiometer has shown to be useful, other suitable potentiometers of different resistance ranges may also be selected by one skilled in the art, as desired.

Figure 2:
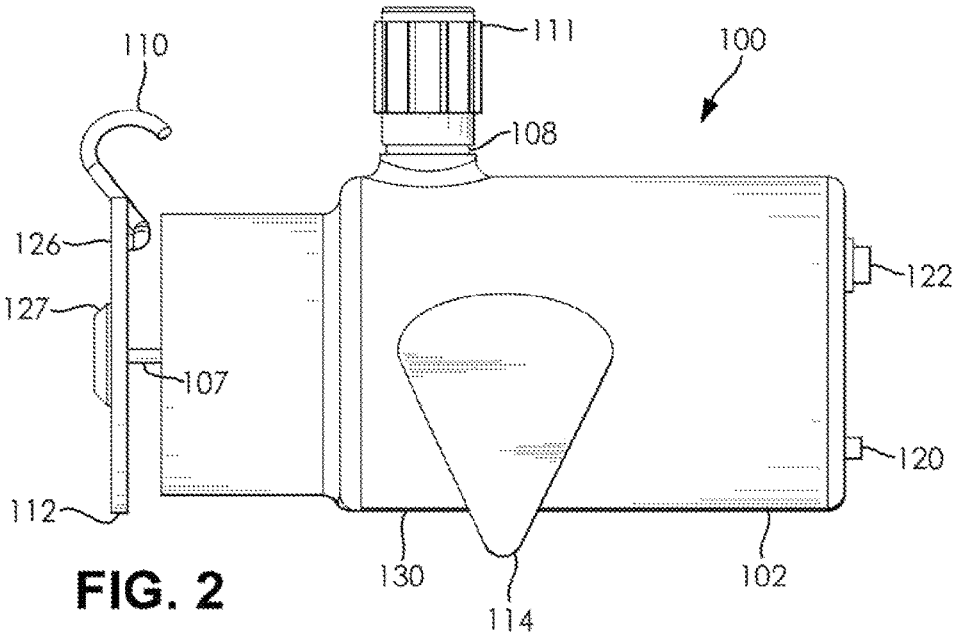
FIG. 2 is a side elevational view of the hand-held strumming device shown in FIG. 1, according to a particular embodiment of the present disclosure.

As illustrated in FIGS. 2-4, the strummer 100 is configured to be presented to the strings of the stringed instrument 101 upon rotation of the motor 106 to strum the strings. For example, the strummer 110 is rotatably disposed on the motor 106. Advantageously, the strummer 110 automates the strumming of the stringed instrument 101, allowing the musician to focus solely on fretting. It is believed that this increased focus allows the musician to learn to fret more rapidly than when required to strum and fret simultaneously.

It should be appreciated that the strummer 110 is thin, sufficiently stiff, and of a length sufficient to contact and strum the strings of the stringed instrument 101. In particular nonlimiting examples, the strummer 110 may include one of a cord and a wire. The cord or wire may further be enclosed in plastic or paper, in order to minimize the potential for damage to the strings of the stringed instrument 101. In a particular embodiment, the strummer 110 is a 30-gauge wire. It should be appreciated that although the 30-gauge wire has shown to be especially useful, other suitable strummers 110 may also be selected by a person skilled in the art, as desired.

Alternative embodiments of the hand-held strumming device 100 can further include one or a combination of the following features or structure: a disk 112; a plectrum 114; a display 116; a speaker 118; a port 120; at least one switch 122; and a force feedback unit 124. Other suitable features or structure of the device 100 may also be employed within the scope of the disclosure.

With reference to FIGS. 2-4, the disk 112 is configured to rotate the strummer 110, for example, via its own rotation by the motor 106. Favorably, the disk 112 allows the strummer 110 to have an increase range and militates the strummer 110 from being entangled around a shaft 107 of the motor 106. In particular, the disk 112 may be rotatably disposed on a shaft 107 of the motor 106. It should be appreciated that a skilled artisan may select different sizes and materials for disk 112 within the scope of this disclosure.

In certain examples, as shown in FIGS. 3 and 4, the disk 112 has at least one aperture 126. The at least one aperture 126 is formed in the disk 112 adjacent a perimeter edge of the disk and is configured to receive the strummer 110. This allows the strummer 110 to be easily tied or affixed to the disk 112 via the aperture 126, instead of having to dispose the strummer 110 through the shaft 107 of the motor 106. In such case, the tying or affixing, for example, by mechanical or chemical fasteners, will militate against an undesirable rotation of the strummer 110 to a position adjacent the disk 112 where the strummer 110 cannot be presented to the strings of the stringed instrument 101. It should also be understood that the at least one aperture 126 may include more than one of the aperture 126 through which the strummer 110 is disposed, in order to also militate against the undesirable rotation. Other means for militating against the undesirable rotation of the strummer 110 to a location that does not permit presentation to the strings may also be employed, as desired.

Moreover, the location of the aperture 126 allows the musician to easily remove and replace existing strummers 110 as they become unusable from wear and tear. In addition, the musician can remove and replace existing strummers 110 with different strummers 110 depending on the application or the stringed instrument 101 being used. For example, a steel-string guitar may require a firmer and more ridged strummer 110.

The device 100 may further include at least one fastener 127. The fastener 127 is disposed adjacent the disk 112 and is configured to removably secure the disk 112 to the shaft 107 of the motor 106. The fastener 127 is disposed on the disk 112 and is configured to prevent the disk 112 from dislodging from the shaft 107 of the motor 106. In a particular embodiment, the fastener 127 may be a nut that is threadably attached to the shaft 107 disposed through a center hole 113 of the disk 112. Alternatively, the fastener 1127 may be pinched or otherwise connected manually to the shaft 107 in order to affix the disk 112 to the shaft 107. It should be appreciated that one skilled in the art may employ different types of structure or materials to connect the disk 112 to the motor 106, as desired.

In a particular embodiment, the disk 112 has the dimensions of 24 mm by 2 mm. It should be appreciated that although these dimensions have been shown to be useful, other suitable dimensions may also be selected by a person skilled in the art within the scope of the disclosure.

As depicted in FIGS. 2 and 3, the plectrum 114 may be disposed on a side of the hollow body 102. More specifically, the plectrum 114 may be positioned to allow for a picking of individual strings of the stringed instrument 101. This conveniently allows the musician to switch between automatically strumming and manually strumming without having set aside the hand-held strumming device 100.

In certain embodiments, the plectrum 114 is made up of a nylon material and is 0.73 mm in length. It should be appreciated that, although the plectrum 114 having these materials and dimensions has shown to be useful, other suitable materials and dimensions for the plectrum 114 may also be selected by the skilled artisan, as desired.

With reference to FIGS. 1 and 4, the display 116 may be configured to show a musician different values and outputs. For example, the display 116 may output the current rotational speed of the motor 106. Advantageously, this allows the musician to narrowly tailor the current strum speed according to the current application or stringed instrument 101. In particular, the display 116 may be disposed on the hollow body 102 in a position that allows the musician to view it while holding the hand-held strumming device 100. For example, the display 116 may be disposed adjacent to the manual adjuster 111 so that the display 116 is otherwise visible between the thumb and index finger of the musician while gripping the device 100.

In particular embodiments, the display 116 is a light emitting diode (LED) display. It should be appreciated that a skilled artisan many select different, positions, sizes, and types of the display 116 within the scope of this disclosure.

Referring now to FIG. 1, the speaker 118 is in electrical communicate with the power source 104. In some examples the speaker 118 is disposed within the hollow body 102. The speaker 118 may be configured to provide audio cues, such as a sound to designate that the device has been activated or deactivated. It should be appreciated that other audio cues may be used within the scope of this disclosure. Also, it should be appreciated that a skilled artisan may select different types and sizes of the speaker 118 within the scope of this disclosure.

As shown in FIGS. 1 and 2, the port 120 is in electrical communication with the power source 104. The port 120 is configured to receive electricity from a cable to recharge the power source 104, in instances wherein the power source 104 is a rechargeable battery. As mentioned previously, this allows a musician to recharge the hand-held strumming device 100 without needing to purchase replacement batteries. In certain examples, the port 120 is disposed through and end or side of the hollow body 102. A nonlimiting example of the port 120 is a Universal Serial Bus (USB) port. However, other suitable types of the port 120 for supplying power to the power source 104 may also be employed.

In further embodiments, the port 120 is further configured to transfer and receive data. Non-limiting examples include transferring set strum rates and information necessary to facilitate a connection to a software application. The set strum rate could be a single predetermined value or be a plurality of values, capable of recreating the strumming of an entire song.

Also, it should be appreciated that a skilled artisan may include additional types of data and data transmission means within the scope of this disclosure. For example, the device 100 may further include a wireless transceiver (not shown) that permits for wireless communication of the data to another device or computer running a suitable software application. Moreover, a skilled artisan may tailor the software application to be a web application or as a mobile application, as desired.

As shown in FIGS. 1 and 2, the at least one switch 122 may be configured to activate or deactivate the hand-held strumming device 100. For example, the at least one switch 122 may be a power switch. The at least one switch 122 may be disposed on the hollow body 102 in a location that militates against it being inadvertently activated or deactivated while the device 100 is being gripped by the musician in operation. For example, the at least one switch 122 may be disposed on an end of the hollow body 102 opposite the end of the hollow body 102 where the strummer 110 is otherwise disposed.

Non-limiting examples of the at least one switch 122 include tactile sensors and push buttons. It should be appreciated that one skilled in the art may select different sizes, types, and locations of the at least one switch 122 within the scope of this disclosure With reference to FIG. 1, the force feedback unit 124 may be disposed within the hollow body 102. The force feedback unit 124 may be configured to provide tactile cues, such as a vibration, in order to designate that the device 100 has been activated or deactivated. It should be appreciated that other suitable tactile cues may be used within the scope of this disclosure.

It should be understood that each of the abovementioned additions, such as the display 116, the speaker 118, and the force feedback unit 124, may further require a microcontroller 128 disposed within the hollow body 104. The microcontroller 128 may include at least one processor and at least one memory. The at least one memory includes a tangible, non-transitory computer readable medium with processor-executable instructions stored thereon. The microcontroller 128 is configured to control the display 116, speaker 118, and the force feedback unit 124, and permit them to operate in accordance with the processor-executable instructions. Other suitable means for controlling the display 116, the speaker 118, and the force feedback unit 124 may also be employed, as desired.

Figure 5:
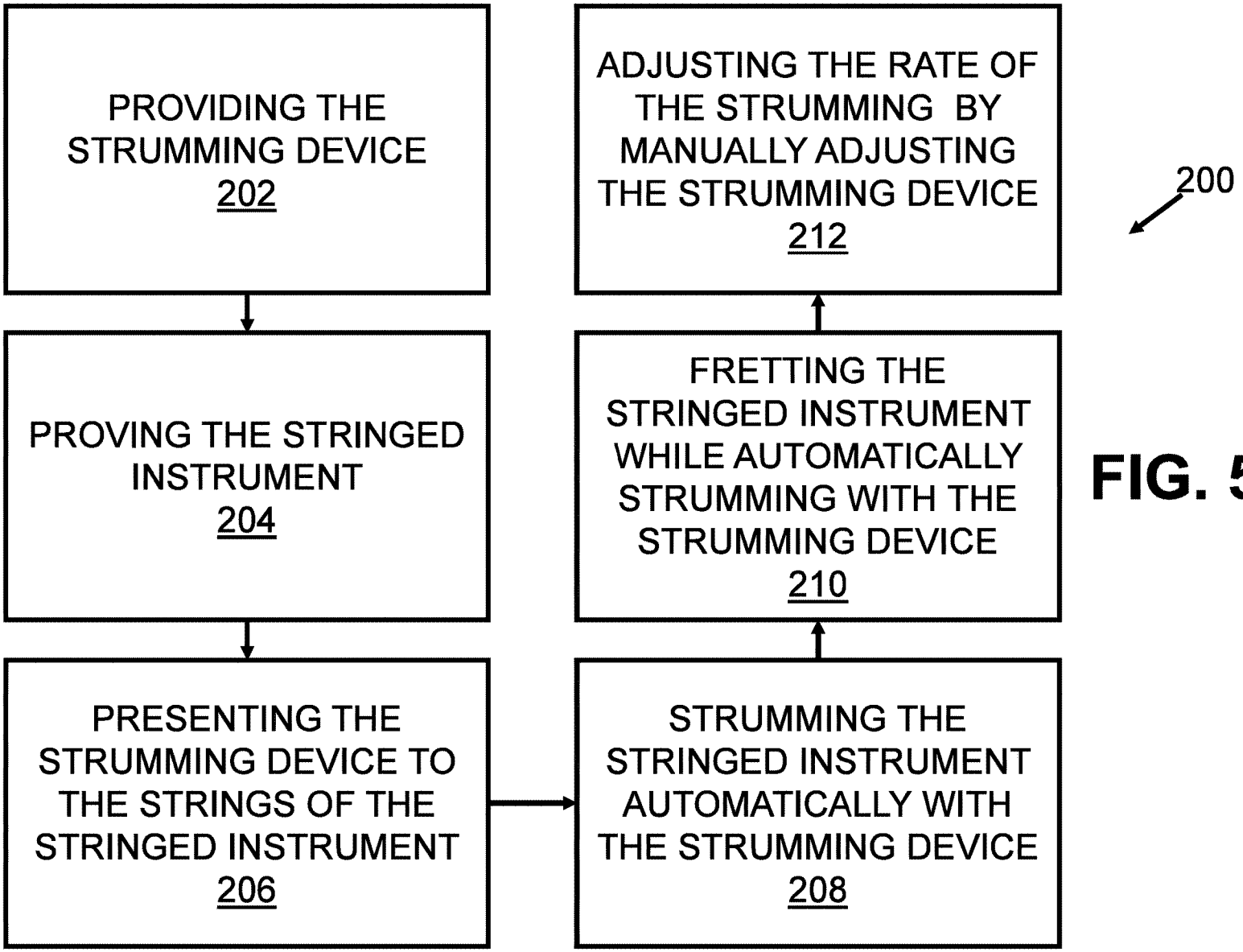
FIG. 5 is a flowchart illustrating a method of playing the stringed instrument using the hand-held strumming device as shown in FIGS. 1-4.

As shown in FIG. 5, a method 200 for playing a stringed instrument 101 includes a first step 202 of providing the hand-held strumming device 100. In a step 204, providing a stringed instrument 101. It should be appreciated that the playing of the stringed instrument 101 may be performed as a learning or practice exercise, or may be otherwise performed during a performance with the stringed instrument 101.

In a step 206, the hand-held device is presented to the strings of the stringed instrument 101. Then, in a step 208 the stringed instrument 101 is strummed automatically with the hand-held strumming device 100. Next, in a step 210, the stringed instrument 101 is fretted while the hand-held strumming device 100 automatically strums the stringed instrument 101. Then, in a step 212, the musician can adjust the rate of the strumming by manually adjusting the hand-held strumming device 100.

Without being bound to a particular theory, it is believed that the method 200 of the present disclosure allows a novice musician to solely focus on fretting while playing the stringed instrument 101. This singular focus allows the novice musician to more quickly learn fretting, so they can eventually learn how to fret and strum simultaneously. Moreover, it is believed that the method 200 is also suitable for some disabled musicians, such as musicians with arthritis, allowing them to strum the stringed instrument 101 better.

In an alternative embodiment, the device 100 may also have a metronome mode that permits for the device 100 to be used as a metronome. For example, the motor 106 may be configured to periodically sway the strummer 110 back-and-forth at a predetermined beats-per-minute. This allows the musician to use the hand-held strumming device 100 both as an automatic strummer and also as a metronome. Conveniently, this means the hand-held strumming device 100 not only helps musician to learn fretting, but that it can also be used to improve their timing, especially the ability to stick to a tempo.

In operation, the musician uses the hand-held strumming device 100 as a metronome by putting the device on a flat portion 130 (shown in FIG. 3) of the hollow body 102. Then, the musician is able to visually see the current beats-per-minute via the strummer 110 swaying back-and-forth.

In addition, the display 116 may be further configured to output values to the musician to assist with using the hand-held strumming device 100 as the metronome. For example, the display 116 may be used as a meter to actively show the current beats-per-minute when using the hand-held strumming device 100 as the metronome. This allows for more fine tuning of the current beats-per-minute value.

In particular embodiments, the speaker 118 can be further configured to periodically emit a sound to a predetermined beats-per-minute. Advantageously, this allows the hand-held strumming device 100 to function as an audible metronome. The audible metronome benefits visually impaired musicians and also allows musicians to use the hand-held strumming device 100 as the metronome without having position device 100 on its flat portion 130.

In further embodiments, the force feedback unit 124 may be configured to periodically emit vibrations according to the predetermined beats-per-minute. This allows the hand-held strumming device 100 to function as a tactile metronome. Thus, the musician can have the functionality of a metronome without having to rely on sight or sound. In addition, this allows the musician to continue using the hand-held strumming device 100 as an auto strummer while also using it as a metronome. Moreover, unlike an audible metronome, the sound from the stringed instrument 101 will not interfere with the metronome functionality.

In an alternative embodiment, the hand-held strumming device 100 may further comprise a microphone, not shown, in order to have a tuning mode that permits the device 100 to function as a tuner for the stringed instrument 101. The microphone is configured to receive sound emitting from the stringed instrument. In some examples, the microphone is in electrical communication with the microcontroller 128. Upon, receiving the sounds emitting from the string instrument, the display 116 is configured to notify the musician if the string instrument 101 is in tune. Some examples may include configuring the speaker 118 to emit a noise notifying the musician if the string instrument 101 is in tune. Further examples may include configuring the force feedback unit 124 to emit a vibration to notify the musician if the string instrument 101 is in tune.

Nonlimiting examples of the notification include: showing a specific color, if the stringed instrument 101 is in tuned; or showing a pulsing light if the stringed instrument 101 is out of tune. It should be appreciated that a skilled artisan may select different ways of notifying the musician that the stringed instrument is in tune or out of tune.

Advantageously, the device 100 described hereinabove is handheld, user-friendly, and inexpensive. The device 100 and the associated method 200 for automating strumming of stringed instruments 101 further allows the musician to have a full range of motion while playing.

While certain representative embodiments and details have been shown for purposes of illustrating the invention, it will be apparent to those skilled in the art that various changes may be made without departing from the scope of the disclosure, which is further described in the following appended claims.

What is claimed is:

1. A hand-held strumming device, comprising:

a hollow body;

a power source disposed in the hollow body;

a motor in electrical communication with the power source;

a regulator in electrical communication with both the motor and the power source, the regulator configured to selectively adjust a rotational speed of the motor; and a strummer rotatably disposed on the motor, the strummer configured to be presented to strings of a stringed instrument upon rotation of the motor to strum the strings.

2. The hand-held strumming device of claim 1, further comprising a disk attached to a shaft of the motor, and the strummer is attached to the disk.

3. The hand-held strumming device of claim 2, wherein the disk has an aperture formed thereon adjacent a perimeter of the disk, the aperture removably receiving the strummer.

4. The hand-held strumming device of claim 1, wherein the disk has a fastener disposed thereon, the fastener removably securing the disk to a shaft of the motor.

5. The hand-held strumming device of claim 1, wherein the power source is a rechargeable battery.

6. The hand-held strumming device of claim 5, further comprising a port disposed through the hollow main body, the port being in electrical communication with the battery.

7. The hand-held strumming device of claim 1, further comprising a plectrum disposed on the hollow body, the plectrum permitting for a picking of individual strings of the stringed instrument.

8. The hand-held strumming device of claim 1, further comprising a switch in electrical communication with the motor and the power source, the switch configured to selectively activate and deactivate the motor.

9. The hand-held strumming device of claim 1, wherein the regulator includes a rotatable manual adjuster for adjustment of the rotational speed of the motor.

10. The hand-held strumming device of claim 9, wherein the manual adjuster is disposed on an outer surface of the hollow body, whereby a position of the manual adjuster allows a thumb or index finger of a musician to selectivity adjust the rotational speed of the motor while the musician holds the hand-held strumming device.

11. The hand-held strumming device of claim 10, wherein the manual adjuster is textured and facilitates a gripping of the manual adjuster by the musician.

12. The hand-held strumming device of claim 1, further comprising a microcontroller in electrical communication with the power source and the regulator, the microcontroller including at least one processor and at least one memory, the at least one memory includes a tangible, non-transitory computer readable medium with processor-executable instructions stored thereon.

13. The hand-held strumming device of claim 12, further comprising a force feedback unit in electrical communication with the microcontroller, the force feedback unit configured to periodically emit a vibration according to a predetermined beats-per-minute.

14. The hand-held strumming device of claim 12, further comprising a display in electrical communication with the microcontroller, the display disposed on the hollow body.

15. The hand-held strumming device of claim 14, wherein the display is a light-emitting diode (LED) display.

16. The hand-held strumming device of claim 12, further comprising a speaker in electrical communication with the power source, the speaker configured to periodically emit a sound according to a predetermined beats-per-minute.

17. The hand-held strumming device of claim 12, wherein the motor is further configured to periodically sway the strummer back-and-forth according to a predetermined beats-per-minute.

18. A hand-held strumming device, comprising:

a hollow body;

a rechargeable battery disposed in the hollow body;

a direct current (DC) motor in electrical communication with the rechargeable battery, the DC motor having a shaft;

a regulator having a rotatable manual adjuster, the regulator being in electrical communication with both the DC motor and the rechargeable battery, the regulator configured to selectively adjust a rotational speed of the DC motor, wherein the rotatable manual adjuster is disposed on an outer surface of the hollow body, the rotatable manual adjuster is textured and facilitates a gripping of the manual adjuster by a musician, and whereby a position of the manual adjuster allows a thumb or index finger of the musician to selectively adjust the rotational speed of the DC motor while the musician holds the hollow body;

a disk attached to the shaft of the DC motor and configured to rotate via the DC motor, the disk including an aperture and a fastener, the aperture formed on the disk adjacent a perimeter of the disk, and the fastener disposed on the disk and removably securing the disk to the shaft of the DC motor;

a strummer rotatably disposed on the disk, the aperture of the disk removably receiving the strummer, the strummer configured to be presented to strings of a stringed instrument upon rotation of the disk to strum the strings;

a port disposed through the hollow body and in electrical communication with the rechargeable battery;

a plectrum disposed on the hollow body and permitting for a picking of individual strings of the stringed instrument; and a power switch in electrical communication with both the rechargeable battery and the DC motor, the power switch configured to selectively activate and deactivate the DC motor.

19. A method of playing a stringed instrument, the method comprising steps of:

providing a hand-held strumming device including a hollow body, and a power source disposed in the hollow body, and a motor in electrical communication with the power source, and a regulator in electrical communication with both the motor and the power source, the regulator configured to selectively adjust a rotational speed of the motor, and a strummer rotatably disposed on the motor, the strummer configured to be presented to strings of a stringed instrument upon rotation of the motor to strum the strings;

providing a stringed instrument;

presenting the hand-held strumming device to the strings of the stringed instrument;

strumming the stringed instrument automatically with the hand-held strumming device; and fretting the stringed instrument, whereby the musician is able to focus solely on the fretting due to automation of the strumming.

20. The method of claim 19, further comprising a step of adjusting a rate of the strumming by manually adjusting the regulator of the hand-held strumming device.

* * * * *